US007604117B2

(12) United States Patent
Bourgoin et al.

(10) Patent No.: US 7,604,117 B2
(45) Date of Patent: Oct. 20, 2009

(54) HINGED LID CONTAINER WITH OUTER SHELL

(75) Inventors: Philippe Bourgoin, Cheseaux (CH); John Vickerstaff, Neuchatel (CH)

(73) Assignee: Philip Morris USA Inc., Richmond, VA (US)

( * ) Notice: Subject to any disclaimer, the term of this patent is extended or adjusted under 35 U.S.C. 154(b) by 2 days.

(21) Appl. No.: 11/984,751

(22) Filed: Nov. 21, 2007

(65) Prior Publication Data

US 2008/0128301 A1 Jun. 5, 2008

(30) Foreign Application Priority Data

Nov. 30, 2006 (EP) ..... 06125140

(51) Int. Cl.
*B65D 85/10* (2006.01)

(52) U.S. Cl. ..... 206/267; 206/268; 206/273

(58) Field of Classification Search ..... 206/1.5, 206/259, 265, 267, 268, 270, 271, 273; 229/125.07, 229/125.08, 125.125, 160.1
See application file for complete search history.

(56) References Cited

U.S. PATENT DOCUMENTS

| | | | | |
|---|---|---|---|---|
| 2,213,525 A | | 9/1940 | LaFlamme | |
| 2,799,441 A | | 7/1957 | Nerney | |
| 2,929,542 A | | 3/1960 | O'Gorman | |
| 3,416,719 A | | 12/1968 | Pilger | |
| 3,899,125 A | * | 8/1975 | Andrews et al. | 206/268 |
| 4,267,926 A | * | 5/1981 | Toimil | 206/268 |
| 4,646,960 A | * | 3/1987 | Challand | 206/259 |
| 4,779,723 A | * | 10/1988 | Focke et al. | 206/273 |
| 6,474,468 B1 | * | 11/2002 | Griffith | 206/267 |
| 6,591,982 B2 | * | 7/2003 | Focke et al. | 206/259 |
| 7,273,145 B2 | * | 9/2007 | Focke et al. | 206/267 |

FOREIGN PATENT DOCUMENTS

| | | |
|---|---|---|
| DE | 570 351 | 2/1933 |
| DE | 20 2005 011562 | 9/2005 |
| FR | 2495 114 | 6/1982 |
| GB | 395 501 | 7/1933 |
| GB | 532 784 | 1/1941 |

OTHER PUBLICATIONS

International Search Report for European Application No. 06125140.1—2308 dated May 2, 2007.

* cited by examiner

*Primary Examiner*—Luan K Bui
(74) *Attorney, Agent, or Firm*—Buchanan Ingersoll & Rooney PC

(57) ABSTRACT

A container includes an outer shell and an inner slide. The outer shell comprises an outer shell front wall, an outer shell rear wall, left and right outer shell side walls and an outer shell stopper flap, and wherein the outer shell at least partially embraces an inner slide. The inner slide comprises a box portion wherein the box portion comprises a box bottom wall, a box front wall and a box rear wall and an inner slide stopper flap. The inner slide further comprises a lid portion wherein the lid portion comprises a lid top wall, and wherein the lid portion is hinged to the box portion at the box rear wall. The outer shell stopper flap and the inner slide stopper flap interact with each other and limit the movement between the outer shell and the inner slide when opening the container, the box front wall comprising the inner slide stopper flap and the outer shell front wall comprising the outer shell stopper flap.

10 Claims, 6 Drawing Sheets

HINGED LID CONTAINER WITH OUTER SHELL

CROSS-REFERENCE TO RELATED APPLICATION

This application claims priority under 35 U.S.C. §119 to European Application No. 06125140.1, filed Nov. 30, 2006, the entire content of which is hereby incorporated by reference.

FIELD OF THE INVENTION

The present invention relates to an improved slide and shell container that finds particular application as a pack for elongate smoking articles such as cigarettes.

BACKGROUND

It is known to pack smoking articles and other consumer goods in containers comprising an outer shell or sleeve and an inner slide or drawer mounted in the outer shell for slidable movement relative thereto. To access goods housed in the inner slide of such "slide and shell" containers, a consumer pushes or pulls the inner slide from an initial closed position, in which the inner slide is surrounded by the outer shell, to an open position, in which a portion of the inner slide projects outwardly from the outer shell in order to expose an open end or side of the inner slide through which the goods may be removed.

Containers of this type are known for example from U.S. Pat. No. 4,646,960 which discloses a slide and shell container comprising an outer shell with an u-shaped stopper flap on the inside of the rear wall of the outer shell. The inner slide of the slide and shell container comprises a box portion and a lid portion hinged to another at the rear wall of the inner slide. The inner slide further comprises a u-shaped stopper flap on the rear wall of the box portion of the inner slide which is aligned in an opposite direction then the stopper flap on the inside of the rear wall of the outer shell. When the outer shell and the inner slide are moved relative to each other, the two opposing stopper flaps engage with each other and stop the opening movement at a predetermined position. However, because of the additional stopper flaps known high-speed manufacturing machines cannot readily be used for the production of these known containers without a complicated and expensive adaptation, if such an adaptation is possible at all. As a consequence these containers are made by hand which is a severe limitation, in particular when high quantities of these types of containers are required.

It would be desirable to provide a container which may at least partially be manufactured on common high-speed manufacturing machines with no or only minor adaptation of these machines.

SUMMARY

According to the invention there is provided a container comprising an outer shell, wherein the outer shell comprises a outer shell front wall, a outer shell rear wall, left and right outer shell side walls and an outer shell stopper flap, and wherein the outer shell at least partially embraces an inner slide, wherein the inner slide comprises a box portion, wherein the box portion of the inner slide comprises a box bottom wall, a box front wall and a box rear wall and a inner slide stopper flap, wherein the inner slide further comprises a lid portion, wherein the lid portion of the inner slide comprises a lid top wall, and wherein the lid portion of the inner slide is hinged to the box portion of the inner slide at the box rear wall and wherein the outer shell stopper flap and the inner slide stopper flap interact with each other and limit the movement between the outer shell and the inner slide when opening the container, wherein the box front wall comprises the inner slide stopper flap and the outer shell front wall comprises the outer shell stopper flap.

Preferably, the box portion of the inner slide further comprises left and right box side walls. Preferably, the lid portion of the inner slide further comprises also left and right lid side walls and a lid front wall. Preferably, the outer shell further comprises a shell bottom wall.

The container according to the present invention allows for the preparation of the inner slide on known manufacturing machines. For example, conventional blanks for making hinge-lid cigarette containers can be modified by simply reducing the size of the flap forming the box front wall, for example by about 2, 3 or 4 centimeters. In a container according to the present invention the box front wall serves as the inner slide stopper flap and its upper edge can interact with the outer shell stopper flap. Irrespective of this modification of the conventional blank of a hinge-lid container regular machinery can still be used.

During the opening of the container and the movement of the outer shell and the inner slide the inner slide stopper flap and the outer shell stopper flap move towards each other until their edges engage, stopping the opening movement. Under normal handling conditions the outer shell is movable relative to the inner slide but is not separable therefrom.

Preferably, the lid portion of the inner slide comprises lateral extension flaps of the lid top wall. These improve the grip on the lid portion of the inner slide and thus facilitate the opening of the container. In this embodiment the shell side walls may or may not cover the lid side walls. The grip on the inner slide may further be improved by a suitable surface treatment of the lid portion of the inner slide that enhances friction, for example locally applied anti-slipping varnish or suitable embossed patterns or any combination thereof.

Instead or in addition to the above-described means to improve the grip on the inner slide of the container, it is also possible to provide means allowing pushing the box portion of the inner slide out of the outer shell in order to open the container. For that purpose at least one of the outer shell front wall, the outer shell rear wall, the left outer shell side wall, the right outer shell side wall and the outer shell bottom wall has a cut-out. For example, a cut-out may be in the outer shell bottom wall with a rectangular, circular or ellipsoidal shape and a size allowing insertion of one or more of the consumer's fingers to open the container. In a further preferred embodiment there are provided cut-outs in the outer shell rear wall and in the outer shell front wall or cut-outs in each of the outer shell side walls, each having a width corresponding roughly to the width of a finger and a length which is adapted to the distance of the opening movement. Thus, the width of these cut-outs is preferably about 1 cm to about 2 cm and in particular about 1.5 cm and the length is preferably about 2 cm to about 4 cm, in particular about 3 cm. In a third preferred embodiment there are cut-outs in the outer shell bottom wall and the outer shell front wall which are connected to each other so that one single cut-out extending from the outer shell bottom wall into the outer shell front wall results. It is also possible to provide cut-outs in the outer shell bottom wall and the outer shell rear wall.

The box rearwall may be hinged directly to the lid top wall. Alternatively, the lid portion of the inner slide contains in addition to the lid top wall also a lid rear wall and preferably also lid side walls and a lid front wall and the box rear wall is then hinged to the lid rear wall. In this preferred version the combined box and lid portions correspond to a regular hinge-lid container as it is commercially available in particular for cigarettes, however, with the box front wall being reduced in size.

Preferably, the box portion of the inner slide has left and right box side walls and the lid portion of the inner slide has left and right lid side walls. It is then further preferred that the size and shape of these side walls are adapted to each other such that when closing the lid the lower edges of the lid side walls lie directly on the upper edges of the box side walls and thus form the combined side walls of the inner slide. In an alternative preferred embodiment the width of the lid front wall slightly exceeds that of the box front wall so that as a consequence the lid side walls partially embrace the box side walls. In order to avoid an increased thickness of the lid in the closed position compared to that of the box, the front edges of the box side walls have cut-outs. These cut-outs are adapted in size to the lid front wall. Thus, the length of the cut-outs along the edge of the box side walls corresponds to the length of the lid front wall in the same direction. The depth of these cut-outs corresponds preferably to the thickness of the lid wall and the thickness of the blank used for making the inner slide or, if an enforcement flap is provided on the inside of the lid front wall, preferably to twice the thickness of the lid front wall.

Preferably, the container further comprises an inner frame between the outer shell and the inner slide attached to the inner slide. Preferably the inner frame extends into the lid portion of the inner slide to improve the closure of the inner slide. Preferably the inner frame comprises a cut-out at the upper edge to facilitate the access to the cigarettes or other consumer goods housed inside the inner slide.

Preferably, the container is a container for elongate smoking articles such as cigarettes. Preferably, the cigarettes inside the container are bundled in an inner wrapper. Preferably, the container houses one single bundle, two bundles or three bundles. If two separate cigarette bundles are present one may contain 13 cigarettes and the other may contain 7 cigarettes for a container housing 20 cigarettes. If three separate cigarette bundles are present one may contain 6 cigarettes and the other two may each contain 7 cigarettes for a container housing 20 cigarettes. Each bundle may contain elongate smoking articles of a different type.

Elongate smoking articles of a different type are for example, cigarettes, cigars or cigarillos comprising different types of tobacco having unique characteristic flavours and aromas, such as Burley, Oriental and Virginia tobacco, which are used alone or in varying amounts in tobacco blends to produce brands of cigarettes having different characteristic flavours. In addition, both plain cigarettes and cigarettes having many different types of filter tips are available as well as cigarettes of differing length and circumference, for example cigarettes of conventional size, king size, super-king size, slim size or super-slim size. Additionally, cigarette types may differ in strength of flavour, total particulate matter delivery and nicotine delivery. Furthermore, cigarettes containing flavourings such as menthol are also available.

Where the inner slide of a slide and shell container according to the present invention houses one or more bundles of cigarettes or other smoking articles, the smoking articles are preferably wrapped in an inner liner of, for example, metal foil, plastic or metallised paper. Preferably, the inner liner may be formed from a material with a high barrier property to enhance the retention of flavor inside the bundle. This may be especially suitable for mentholated cigarettes. Additionally, the inner liner may comprise a means to reclose or reseal the bundle.

The dimensions of the outer shell correspond to the above-described dimensions of the container provided the outer shell completely covers the box front, rear and bottom wall and the lid front and rear wall. However, it is also possible that the outer shell, in addition to only a partial coverage of the lid side walls, does not cover or only partially cover the lid front or the lid rear wall or both. Finally, it is also possible that the outer shell does not cover any lid wall and only partially covers the box front, rear and side walls. The dimensions of the outer shell are then correspondingly reduced compared to the dimensions of the container as detailed above.

Preferably, the external dimensions of the inner slide of the container according to the present invention are substantially the same as the internal dimensions of the outer shell thereof. In use, frictional forces generated between inner surfaces of the outer shell that overlie and abut outer surfaces of the inner slide resist slidable movement of the inner slide within the outer shell between the closed position and the open position, thereby advantageously preventing opening and closing of the slide and shell container without the application of a positive force by a consumer.

The outer shell and the inner slide of slide and shell containers according to the invention may be formed from the same or different materials. The outer shell and the inner slide of containers according to the invention may, for example, be formed from cardboard, paperboard, plastic, metal or combinations thereof of from any other suitable material.

Preferably, the outer shell and the inner slide are formed from folded laminar blanks, more preferably from folded laminar cardboard blanks.

The outer or inner surface of the outer shell or the inner slide of slide and shell containers according to the present invention may be printed, embossed or otherwise embellished (for example, using labels or stickers) with manufacturer or brand logos, trade marks, slogans or other consumer information and indicia or any combination thereof.

The outer shell and the inner slide of slide and shell containers according to the invention may have right-angled longitudinal edges, right-angled transverse edges, rounded longitudinal edges, rounded transverse edges, beveled longitudinal edges, beveled transverse edges or any suitable combination thereof.

For example, by scoring in a known manner laminar cardboard blanks from which the outer shell and the inner slide are erected, a "rounded-corner" slide and shell container of smoking articles or other consumer goods according to the invention may be formed. Additionally, the inner slide may be formed like any existing hinge-lid container with a modified box front wall such as a hinge-lid container with a triangular, rectangular, square, trapezoidal, hexagonal, octagonal, oval, circular, semi-circular, ellipsoid or any other cross section.

Slide and shell containers of elongate smoking articles or other consumer goods according to the present invention may be shrink wrapped or otherwise over wrapped with a transparent polymeric film of, for example, polyethylene or polypropylene in a conventional manner. Where slide and shell containers according to the invention are over wrapped, the over wrapper may include a tear tape.

BRIEF DESCRIPTION OF THE DRAWINGS

The invention will be explained in more detail in the following. There are shown in.

DETAILED DESCRIPTION

Figure 1:
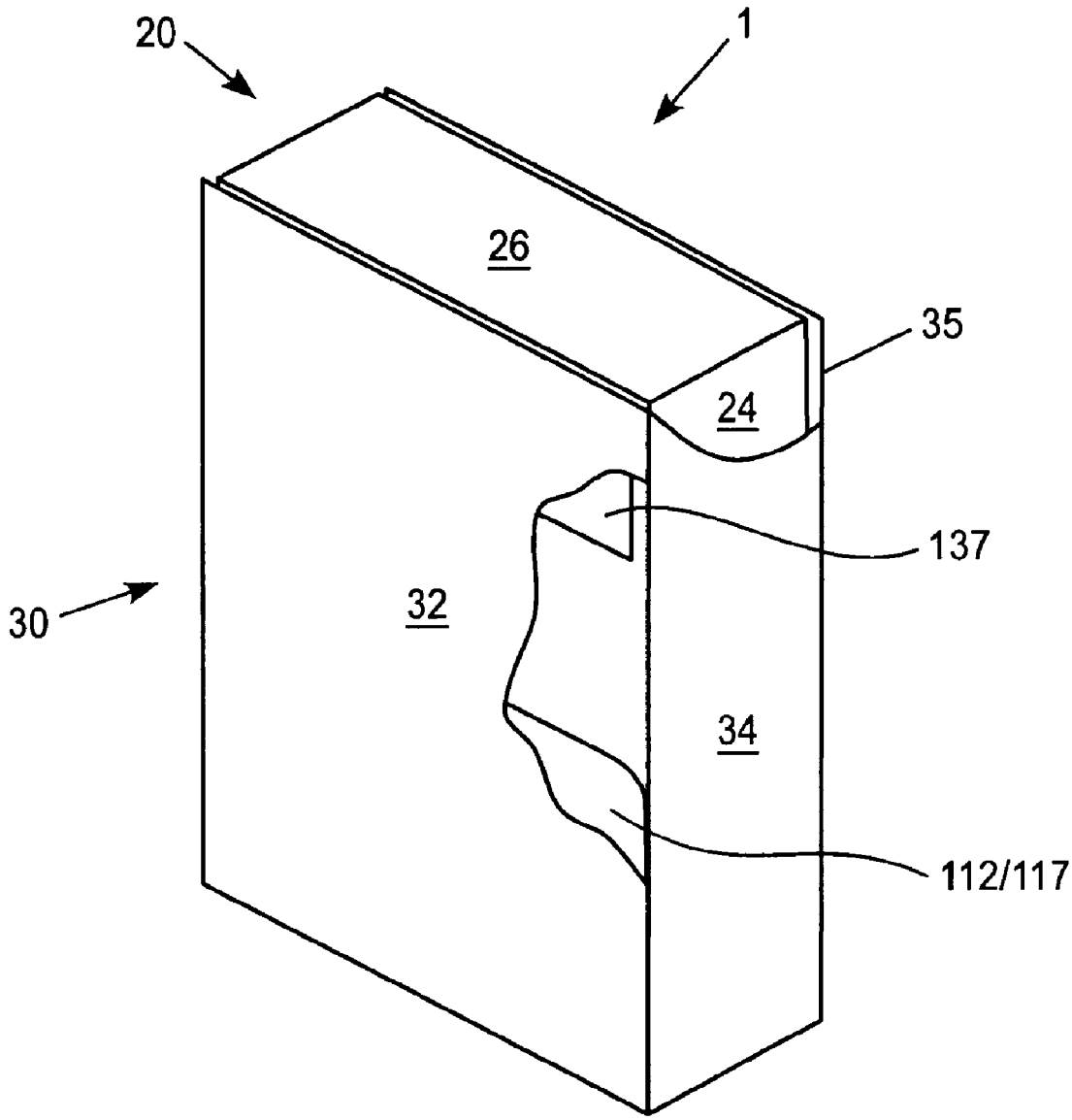
FIG. 1 a perspective view of a container according to a first embodiment according to the invention in closed position, FIG. 2 a perspective view of the container of FIG. 1 in open position, FIG. 3 a perspective view of a container according to a second embodiment according to the invention in open position, FIG. 4 a perspective view of a container according to a third embodiment according to the invention in open position, FIG. 5 a one piece laminar cardboard blank for forming the inner slide of a container according to the invention, and FIG. 6 a one piece laminar cardboard blank for forming the outer shell of a container according to the invention

FIG. 1 shows a container 1 in closed position. The outer shell 30 with its outer shell front wall 32, its outer shell rear wall 35 and its right outer shell side wall 34 are visible. The lid portion 20 of the inner slide 10, 20 with its lid top wall 26 and its right lid side wall 24 are shown. The size of the outer shell side wall 34 is such that part of the right lid side wall 24 is not covered by the right outer shell side wall 34.

Figure 2:
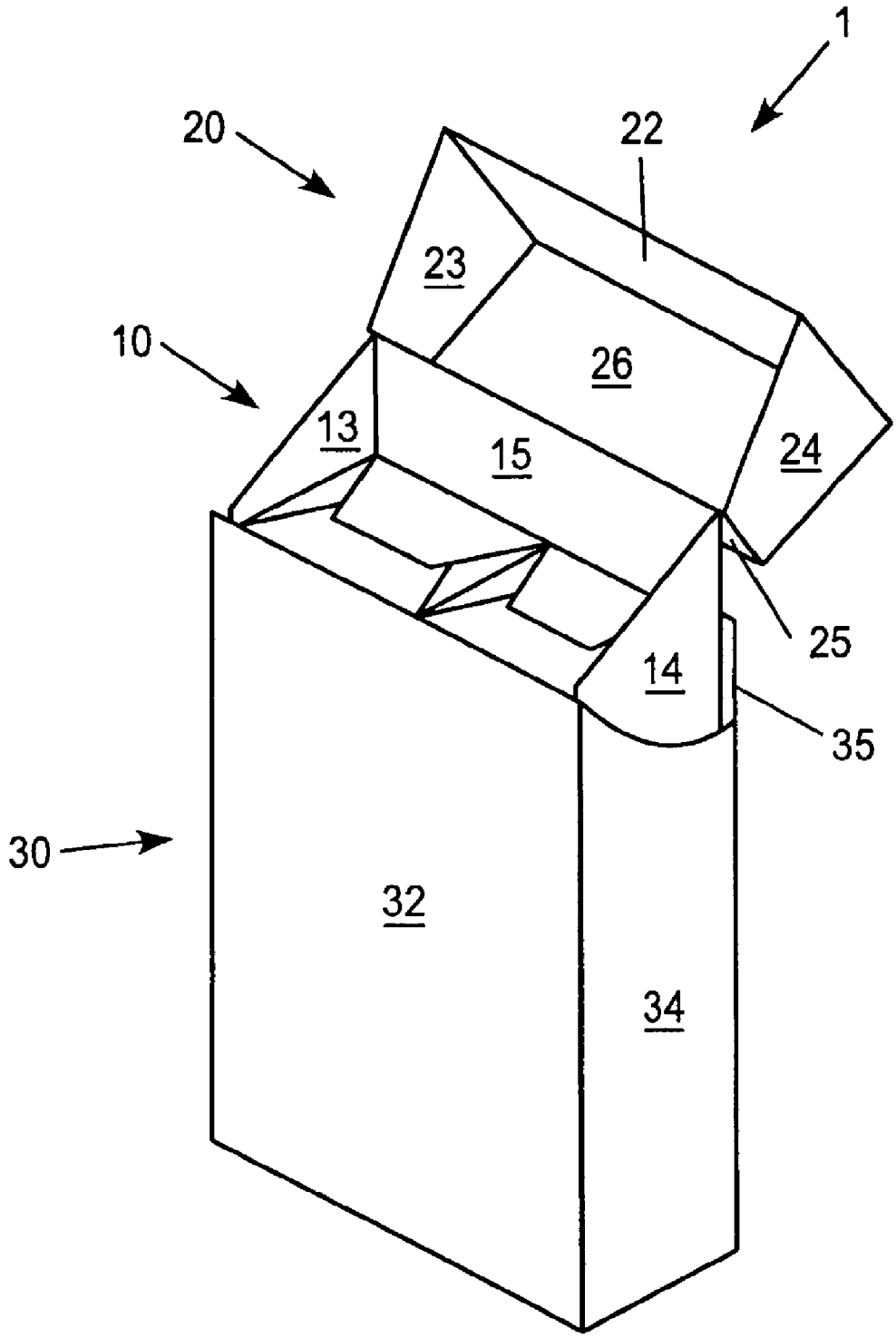

FIG. 2 shows the container 1 of FIG. 1 after opening. Beside the outer shell 30 with its shell front wall 32, its shell rear wall 35 and its right outer shell side wall 34. The box portion 10 of the inner slide 10, 20 can be seen with its left box side wall 13 and right 14 box side wall and its box rear wall 15. The box portion 10 of the inner slide 10, 20 is partially pulled out of the outer shell 30. The lid portion 20 of the inner slide 10, 20 is connected to the box portion 10 of the inner slide 10, 20 by a hinge between the box rear wall 15 and the lid rear wall 25. The lid 20 of the inner slide 10, is completely open so that any goods (not shown) contained in the container 1 are accessible. For closing the container the consumer may apply a slight pressure on the lid top wall 26 whereupon the box portion 10 of the inner slide 10, 20 and the lid portion 20 of the inner slide 10, 20 will slide into the outer shell 30.

Figure 3:
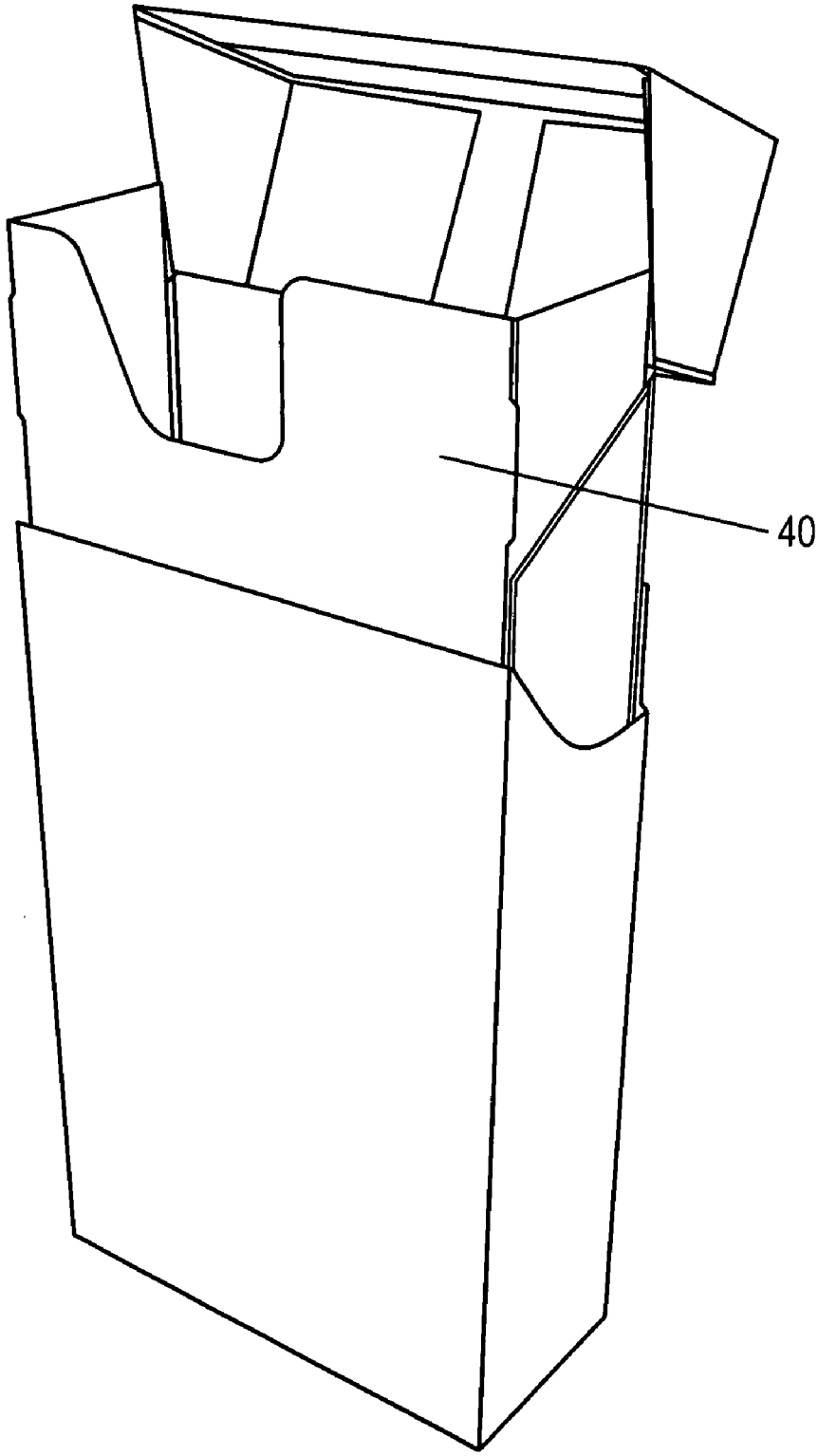

FIG. 3 shows a second embodiment of the container 1, which is like the first embodiment of the container 1, but further comprising an inner frame 40. The inner frame 40 has a cut-out along the upper edge, close to the lid portion 20 of the inner slide 10, 20.

Figure 4:
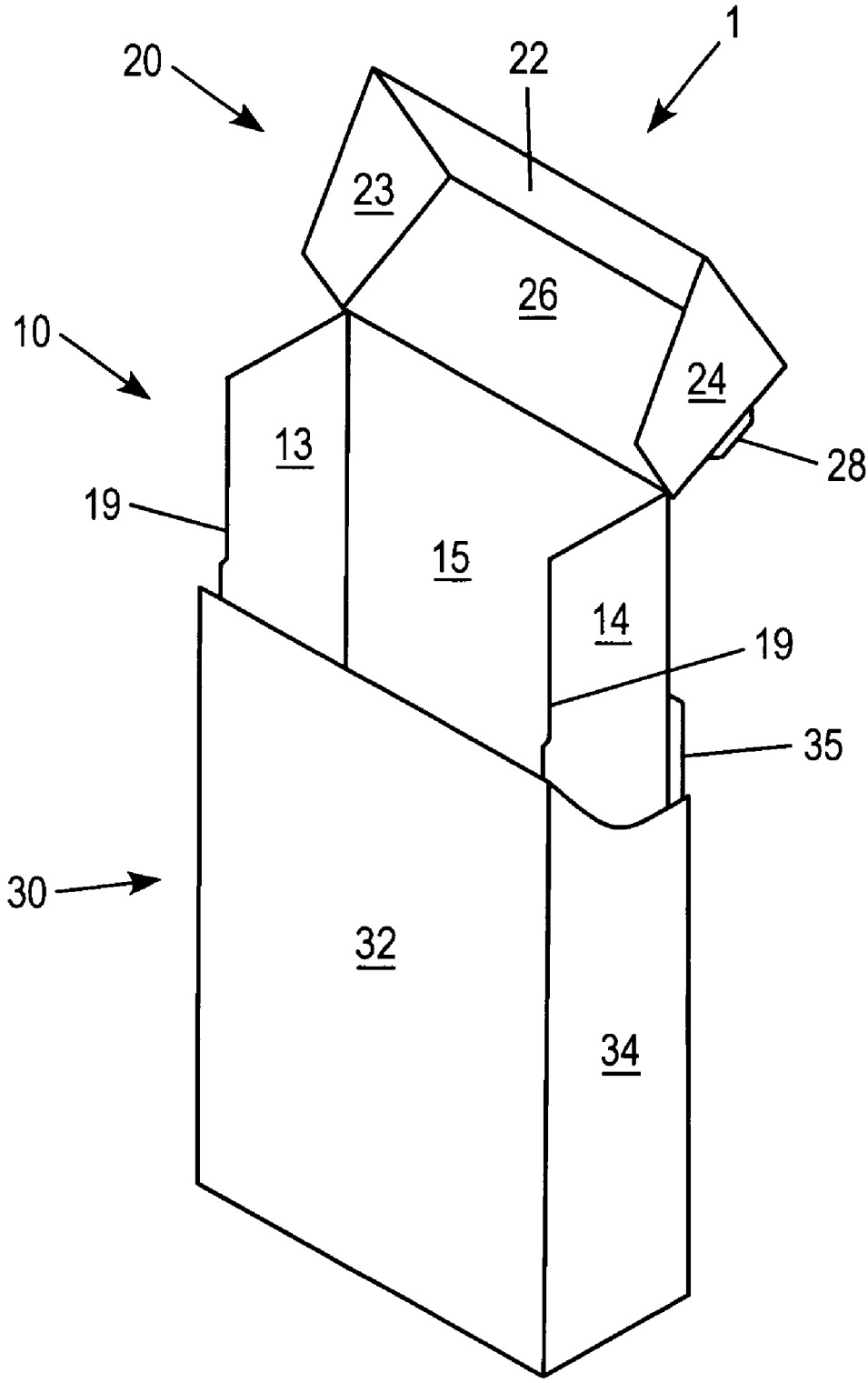

FIG. 4 shows a third embodiment of the container 1 in its open position. The outer shell 30 is similar to the outer shell 30 as in the first embodiment of the container 1 shown in FIG. 1 and FIG. 2. However, as can be seen from FIG. 4 the lid portion 20 of the inner slide 10, 20 is hinged to the box portion 10 of the inner slide 10, 20 by a hinge between the box rear wall 15 and the lid top wall 26. To allow for an easy opening of the container 1 the lid portion 20 of the inner slide 10, 20 extension flaps 28 are formed on both sides of the lid portion 20 of the inner slide 10, 20. These extension flaps 28 are protruding so that the consumer may grip same and pull the lid portion 20 and the box portion 10 of the inner slide 10, 20 out of the outer shell 30. The container 1 of FIG. 4 further has box side walls 13, 14 which, once the lid portion 20 of the inner slide 10, 20 is closed, reach to the inside of lid top wall 26. Thus, upon closing the lid portion 20 of the inner slide 10, 20 the lid side walls 23, 24 slide along the outer sides of the box side walls 13, 14 until they reach the front edges of the box side walls 13, 14. These box side walls 13, 14 are recessed by the thickness and length of the lid front wall 22 forming cut-outs 19 on which the lid front wall 22 lies when the lid 20 is closed.

Figure 5:
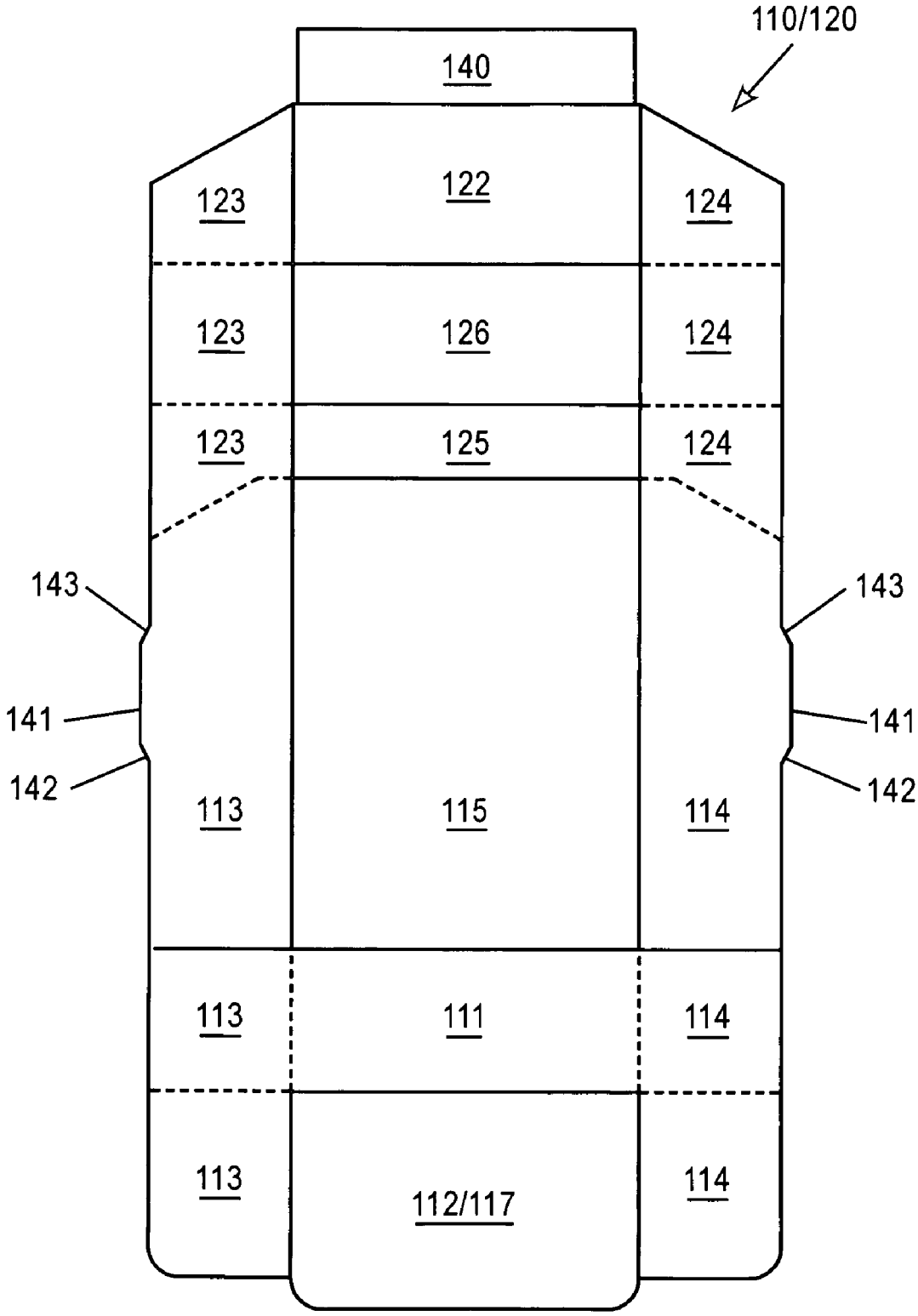

FIG. 5 shows a blank 110, 120 for forming the box portion 10 of the inner slide 10, 20 and the lid portion 20 of the inner slide 10, 20 hinged to the box portion 10 of the inner slide 10, 20. Dotted lines represent cuts in the blank. Surfaces or flaps corresponding to walls in the completed container bear similar reference numerals plus 100. Main surface flaps 112, 117, 111, 115 and the corresponding side-surface flaps 113 and 114 form the box front wall 12, the box bottom wall 11, the box rear wall 15 and the left and right box side walls 13 and 14. Flap 112, 117 forms the box front wall 12 and at the same time the stopper flap 17. Main surface flaps 125, 126 and 122 with the corresponding side-surface flaps 123 and 124 form after assembly the lid rear wall 25, the lid top wall 26 and the lid front wall 22 and the left and right lid side walls 23 and 24.

To produce the inner slide 10, 20 the side-surface flaps 113 and 114 are folded upwards by 90 degrees. Then flaps 112, 117 and 111 are each folded upwards by 90 degrees and attached to the respective side-surface flaps 113 and 114 to provide the final box part 10. Similarly the lid portion 20 is formed. In addition, strengthening flap 140 is bent inwardly and attached to flap 122.

Extension flaps 141 serve to provide a constant thickness or depth of the final inner slide 10, 20. When the blank is folded as described above, flap 112, 117 forming the box front wall 12 reaches exactly to the lower edge 142 of extension flap 141. When the blank is folded as described above, flap 122 (including the inwardly bend strengthening flap 140) forming the lid front wall 22 reaches exactly to the upper edge 143 of extension flap 141. The thickness of the extension flaps 141 corresponds about to the thickness of the box front wall 12 and the lid front wall 22 so that the missing side wall thickness between the upper edge of the box front wall 12 and the lower edge of the lid front wall 22 is compensated by extension flaps 141.

Figure 6:
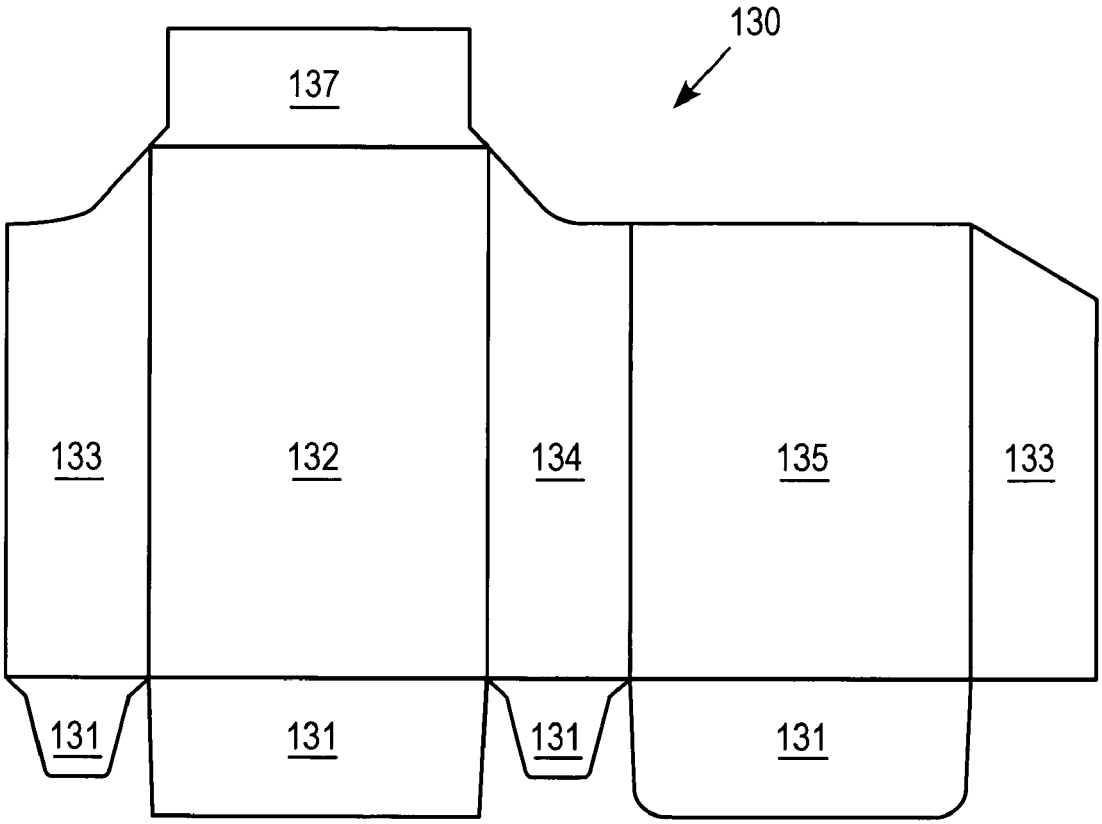

FIG. 6 shows a blank 130 for forming the outer shell 30. Main surface flaps 131, 132 and 135 with the corresponding side-surface flaps 133 and 134 form the outer shell bottom wall 31, the outer shell front wall 32, the outer shell rear wall 35 and the left and right outer shell side walls 33 and 34. Attached to main surface flap 132 is flap 137 which during assembly of the outer shell 30 is bent inwardly and may be attached to the inner side of flap 132 or outer shell front wall 32 and forms outer shell stopper flap 37.

The invention claimed is:

1. A container comprising an outer shell, wherein the outer shell comprises an outer shell front wall, an outer shell rear wall, left and right outer shell side walls and an outer shell stopper flap, and wherein the outer shell at least partially embraces an inner slide, wherein the inner slide comprises a box portion, wherein the box portion of the inner slide comprises a box bottom wall, a box front wall and a box rear wall and an inner slide stopper flap, wherein the inner slide further comprises a lid portion, wherein the lid portion of the inner slide comprises a lid top wall, and wherein the lid portion of the inner slide is hinged to the box portion of the inner slide at the box rear wall and wherein the outer shell stopper flap and the inner slide stopper flap interact with each other and limit the movement between the outer shell and the inner slide when opening the container, wherein the box front wall comprises the inner slide stopper flap and the outer shell front wall comprises the outer shell stopper flap, wherein the lid portion of the inner slide further comprises a left lid side wall and a right lid side wall and wherein the left outer shell side wall and right outer shell side wall have a size such that the lid side walls are not completely covered by the outer shell side walls, and wherein the lid top wall further comprises extension flaps protruding over the lid side walls or the outer shell side walls.

2. The container according to claim 1, wherein the lid top wall is hinged to the box rear wall.

3. The container according to claim 1, wherein the lid portion of the inner slide further comprises a lid rear wall and the lid rear wall is hinged to the box rear wall.

4. The container according to claim 1, wherein the lid portion of the inner slide further comprises a lid front wall, the box portion of the inner slide further comprises a left box side wall and a right box side wall which have cut-outs adapted to the lid front wall such that in the closed position the lid front wall lies within the cut-outs of the box side walls.

5. The container according to claim 1, wherein at least one of the outer shell front wall, the outer shell rear wall, the left outer shell side wall, the right outer shell side wall and the outer shell bottom wall has a cut-out.

6. The container according to claim 1, wherein the box front wall is the inner slide stopper flap and the outer shell stopper flap is formed by an increased thickness of the inside of the upper part of the outer shell front wall.

7. The container according to claim 1, containing two or more separately wrapped bundles.

8. The container according to claim 7, wherein at least one of the bundles is formed by an inner liner adapted to reclose or reseal the bundle or wherein the inner liner is formed from a material with a high barrier property to enhance the retention of flavor inside the bundle or combinations thereof.

9. The container according to claim 1, wherein the inner slide further comprises an inner frame.

10. A container comprising an outer shell, wherein the outer shell comprises an outer shell front wall, an outer shell rear wall, left and right outer shell side walls and an outer shell stopper flap, and wherein the outer shell at least partially embraces an inner slide, wherein the inner slide comprises a box portion, wherein the box portion of the inner slide comprises a box bottom wall, a box front wall and a box rear wall and an inner slide stopper flap, wherein the inner slide further comprises a lid portion, wherein the lid portion of the inner slide comprises a lid top wall, and wherein the lid portion of the inner slide is hinged to the box portion of the inner slide at the box rear wall and wherein the outer shell stopper flap and the inner slide stopper flap interact with each other and limit the movement between the outer shell and the inner slide when opening the container, wherein the box front wall comprises the inner slide stopper flap and the outer shell front wall comprises the outer shell stopper flap; and wherein at least a surface section of the lid portion of the inner slide is treated to enhance friction by an anti-slipping varnish or a suitable embossed pattern or any combination thereof.

* * * * *